US011740059B2

(12) United States Patent
Laporte et al.

(10) Patent No.: US 11,740,059 B2
(45) Date of Patent: Aug. 29, 2023

(54) TARGET LAUNCHING MACHINE FOR SKEET SHOOTING

(71) Applicant: LAPORTE HOLDING, Biot (FR)

(72) Inventors: Jean-Michel Laporte, Biot (FR); Jean-Marc Fouques, Antibes (FR)

(73) Assignee: LAPORTE HOLDING, Biot (FR)

( * ) Notice: Subject to any disclaimer, the term of this patent is extended or adjusted under 35 U.S.C. 154(b) by 0 days.

(21) Appl. No.: 17/642,669

(22) PCT Filed: Sep. 11, 2020

(86) PCT No.: PCT/EP2020/075568
§ 371 (c)(1),
(2) Date: Mar. 11, 2022

(87) PCT Pub. No.: WO2021/048421
PCT Pub. Date: Mar. 18, 2021

(65) Prior Publication Data

US 2022/0325990 A1 Oct. 13, 2022

(30) Foreign Application Priority Data

Sep. 13, 2019 (FR) ..... 1910116

(51) Int. Cl.
*F41J 9/20* (2006.01)
*F41J 9/24* (2006.01)
*F41J 9/32* (2006.01)

(52) U.S. Cl.
CPC .. *F41J 9/24* (2013.01); *F41J 9/32* (2013.01)

(58) Field of Classification Search
CPC .. F41J 9/18; F41J 9/20; F41J 9/24; F41J 9/32
USPC ..... 124/6, 7, 8
See application file for complete search history.

(56) References Cited

U.S. PATENT DOCUMENTS 806,663 A * 12/1905 Hardy ..... F41J 9/20 248/185.1
956,117 A * 4/1910 Lord ..... F41J 9/32 124/43
1,093,524 A * 4/1914 Best ..... F41J 9/20 124/43
1,506,992 A * 9/1924 North ..... F41J 9/20 124/8
1,564,884 A * 12/1925 North ..... F41J 9/20 124/32

(Continued)

FOREIGN PATENT DOCUMENTS

FR 2557283 A1 6/1985

OTHER PUBLICATIONS

Laporte, "185 DTL 60 Owners Manual Installation and operation," Jun. 30, 2015, pp. 1-12.

(Continued)

*Primary Examiner* — Alexander R Niconovich
(74) *Attorney, Agent, or Firm* — HAUPTMAN HAM, LLP

(57) ABSTRACT

A target launching machine for skeet shooting including a launching device, an accumulator device, a triggering device capable of loading the accumulator device and of releasing it to project the target and a preloader device capable of adjusting a preload of the accumulator device, wherein the preloader device includes a linear actuator and flexible transmission member connecting the linear actuator to the accumulator device.

12 Claims, 5 Drawing Sheets

(56) References Cited

U.S. PATENT DOCUMENTS 1,602,471 A * 10/1926 Winans ..... F41J 9/20 124/43
2,025,903 A * 12/1935 Roth ..... F41J 9/20 43/84
2,135,603 A * 11/1938 Roth ..... F41J 9/20 124/32
2,136,034 A * 11/1938 Altemus ..... F41J 9/20 124/31
2,193,266 A * 3/1940 Betts ..... F41J 9/20 124/8
2,245,258 A * 6/1941 Darrell ..... F41J 9/24 124/8
2,711,163 A * 6/1955 Richardson ..... F41J 9/20 124/32
2,980,095 A * 4/1961 Hoag ..... F41J 9/20 248/346.04
3,179,101 A * 4/1965 Luebkeman ..... F41J 9/20 124/43
3,470,860 A * 10/1969 Kane ..... F41J 9/20 124/36
3,552,371 A * 1/1971 Kahelin ..... A63B 69/408 124/36
3,601,112 A * 8/1971 Dale ..... F41J 9/20 124/80
3,923,033 A * 12/1975 Laporte ..... F41J 9/24 124/43
3,971,357 A * 7/1976 LaPorte ..... F41J 9/24 124/43
4,481,932 A * 11/1984 Olson ..... F41J 9/20 124/43
6,026,796 A * 2/2000 LaPorte ..... F41J 9/18 124/8
6,062,207 A * 5/2000 Underhill ..... F41J 9/20 124/8
6,159,112 A * 12/2000 Ciluffo ..... A63B 69/0026 124/4
9,605,931 B2 * 3/2017 Laporte ..... F41J 9/20
9,835,421 B2 * 12/2017 Laporte ..... F41J 9/18
10,458,760 B1 * 10/2019 Liu ..... F41J 9/20
10,545,011 B1 * 1/2020 Collins ..... F41J 9/18
10,746,513 B1 * 8/2020 Liu ..... F41J 9/24
11,441,879 B1 * 9/2022 Dunning ..... F41J 9/24
2006/0065258 A1 * 3/2006 Lovell ..... F41J 9/30 124/9

OTHER PUBLICATIONS

International Search Report issued in corresponding international Application No. PCT/EP2020/075568, dated Dec. 16, 2020, pp. 1-2, European Patent Office, Rijswijk, Netherlands.
Written Opinion Issued In corresponding international Application No. PCT/EP2020/075568, dated Dec. 16, 2020, pp. 1-9, European Patent Office, Rijswijk, Netherlands.

* cited by examiner

TARGET LAUNCHING MACHINE FOR SKEET SHOOTING

The present application is a U.S. National Phase of International Application Number PCT/EP2020/075568, filed Sep. 11, 2020, which claims priority to French Application No. 1910116, filed Sep. 13, 2019.

TECHNICAL FIELD OF THE INVENTION

The invention relates to the field of target launching machines for skeet shooting.

STATE OF THE ART

It is known, for example from FR 2557283 A1, a target launching machine for skeet shooting. A target, also called clay pigeon, is a plate-shaped part usually about 11 cm in diameter made of fragile material, weighing about 100 g. Such a target is launched into the air to be shot by a shooter, usually with a shotgun. In order to better simulate a hunting action, it is advantageous to be able to vary the trajectories of the targets between two launches. For this, a machine can be movable in a deposit and/or on-site. It is still advantageous to be able to change the initial speed of a target from one launch to the other.

Also, as illustrated in FIG. 1, such a target launching machine 1 for skeet shooting comprises a launching device 2 comprising a rotary projection arm 21, about an axis 24. This projection arm 21 is adapted to receive, on the distal end 22 thereof, at least one target, disposed on the edge thereof. The machine 1 also comprises an accumulator device 3 comprising means for accumulating mechanical energy, typically in an elastic component. This elastic component can be a spring 31 of any shape and means of action: circular, tension, compression, etc. The figure shows a tension spring 31 which accumulates elastic energy when it is tensioned and restores it by returning to position when it is released. A first end 32 of said spring 31 is secured to the proximal end 23 of the projection arm 21.

The machine 1 further comprises a triggering device 4 capable of actuating the projection arm 21. For this, in a first step, the triggering device 4 displaces the proximal end 23 of the projection arm 21 and therewith the first end 32 of the spring 31. In doing so, the spring 31 is loaded, thereby accumulating an elastic energy. In a second step, the triggering device 4 releases the proximal end 23 of the projection arm 21. Under the action of the spring 31 which releases the previously accumulated elastic energy, the projection arm 21 is quickly moved so as to projecting said at least one target.

The triggering is for example obtained by means of a rotary motor 42 driving a first finger 41 eccentric about an axis 43. This first finger 41 hooks a second finger 25 secured to the proximal end 23 of the projection arm 21. In a first portion of its stroke, the first finger 41 loads the spring 31, herein tensioned, and arms the device. By continuing its stroke, the first finger 41 unhooks and releases the second finger 25 and therewith the spring 31 and the projection arm 21. Throughout the triggering, the second end 33 of the spring 31 remains stationary.

In order to change the initial speed of the target during its projection, it is advantageous to change the initial load of the spring 31, by displacing the second end 33 thereof. For this, there is used a preloader device capable of adjusting a preload of the spring 31 by displacing the second end 33 thereof.

According to the prior art, such a preloader device 6 may comprise a rigid blade 62 which can rotate about an axis 64, secured at one end to the second end 33 of the spring 31 and mobilised at the other end thereof, by an eccentric 63 driven by a rotary motor 61.

Such a preloader device 6 is bulky and is very limited in terms of travel conferred on the second end 33 of the spring 31. In addition, the driving thereof, by a rotary motor, which is difficult to identify in angular position, is delicate and therefore difficult to be accurate and/or reproducible. The invention also proposes to revisit the preloader device in order to improve it and at least partially overcome these drawbacks.

SUMMARY OF THE INVENTION

According to one aspect, there is proposed a preloader device comprising a linear actuator and flexible transmission means connecting the linear actuator to the second end of the spring.

Also, there is presented a machine for launching at least one target, such as a clay pigeon for skeet shooting, comprising: a launching device comprising a rotary projection arm capable of projecting at least one target, an accumulator device comprising a spring including a first end being secured to a proximal end of the projection arm, a triggering device capable, in a first step, of displacing the proximal end of the projection arm and the first end of the spring by loading the spring so as to accumulate an elastic energy and, in a second step, of releasing the proximal end of the projection arm, which under the action of the spring releasing the previously accumulated elastic energy, projects said at least one target, and a preloader device capable of adjusting a preload of the spring by displacing a second end of the spring, where the preloader device comprises a linear actuator and a flexible transmission member connecting the linear actuator to the second end of the spring.

According to one possibility, the flexible nature of the member allows giving slack to this member before tensioning the spring, in a variable manner, so as to change the load of the spring before launching.

Another aspect relates to a method for adjusting the speed and the distance of shot of a target, comprising changing the tension of a flexible transmission member linked to the spring, in a phase preceding the target projection.

BRIEF DESCRIPTION OF THE FIGURES

The aims, objects, as well as the features and advantages of the invention will emerge better from the detailed description of an embodiment thereof which is illustrated by the following accompanying drawings in which.

The drawings are given by way of examples and are not limiting to the invention. They constitute schematic representations of principle intended to facilitate the understanding of the invention and are not necessarily at the scale of the practical applications.

DETAILED DESCRIPTION OF THE INVENTION

Particular features or embodiments, which can be used alone or in combination, are:

- the preloader device is capable of leaving slack in the flexible transmission means in order to create a negative preload, in other words, there is a delay in loading the spring, this delay being called negative preload, ; thus, at the initiation of the first step, corresponding to the displacements of the proximal end of the projection arm and the first end of the spring, the spring is not immediately loaded because of the slack left in the flexible member; it is only during displacement that the spring load begins to accumulate the elastic energy;
- the preloader device further comprises a deflection pulley disposed on the flexible transmission member; this arrangement being relative, it can also be drawn therefrom that the flexible transmission member is applied on the pulley;
- the deflection pulley also comprises a guide preventing the flexible transmission mean from leaving the deflection pulley,
- the guide comprises at least one passage of a strand of the transmission member in a shroud of the machine,
- the guide comprises a casing surrounding a peripheral portion of the deflection pulley,
- the linear actuator and the deflection pulley are advantageously secured to the machine, they are disposed so that the deflection pulley is equidistant from the spring and the linear actuator; preferably, this allows having two strands of the flexible transmission member forming an identical angle around the belt,
- the flexible transmission member comprises or is selected from a cable, a chain, a rope or a belt.
- the linear actuator comprises a preferably electric cylinder;
- the machine comprises a system for guiding the spring along the longitudinal dimension thereof;
- the guide system comprises at least one rod oriented parallel to the longitudinal dimension and mounted on a shroud of the machine, and a support part secured to the second end of the spring and comprising, for each rod, a hole for guiding said rod.

Figure 1:
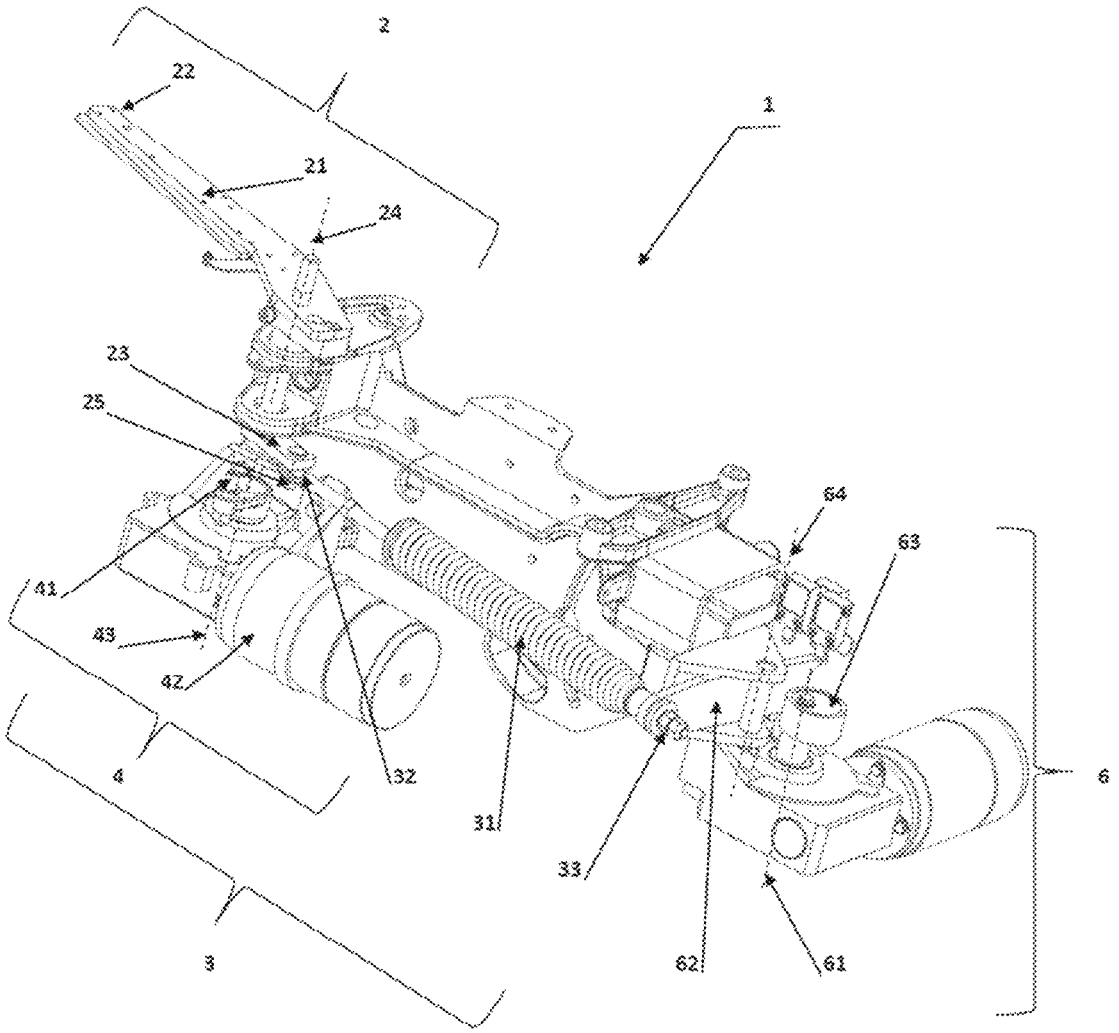
FIG. 1 already described, shows an embodiment of a machine according to the prior art.

The kinematic elements described with reference to FIG. 1 are advantageously included in the kinematics of a machine according to the invention, it can be observed that the entire upper portion, comprising the launching device 2, the accumulator device 3, the triggering device 4 remains the same. Only the preloader device 6 is replaced by a preloader device.

The preloader device according to the invention always interfaces with the second end 33 of the spring 31. The latter is preferably a coil spring; it may be a tension spring. It extends along a longitudinal dimension, typically the winding axis of the coils when it is a coil spring. The preloader device comprises a linear actuator 51. A flexible transmission means or member 52 connects the linear actuator 51 to the second end 33 of the spring 31. Thus the preloader device can apply a preload to the spring 31 by changing the length of the linear actuator 51.

Relative to the prior art, the linear actuator 51 advantageously allows a much more extensive preload stroke, since substantially equal to the stroke of said linear actuator 51. In addition, a linear actuator 51, such as a cylinder, or a ball screw, allows a very accurate monitoring of the developed rod length and thus of the value of the applied preload.

Figure 3:
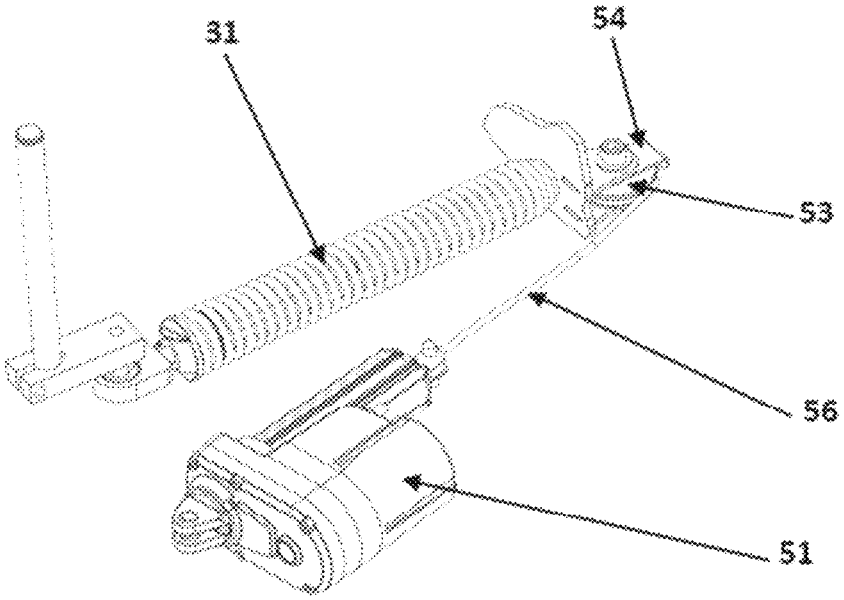
FIG. 3 shows the machine according to the invention with the actuator shortened to the maximum for a maximum preload.
Figure 4:
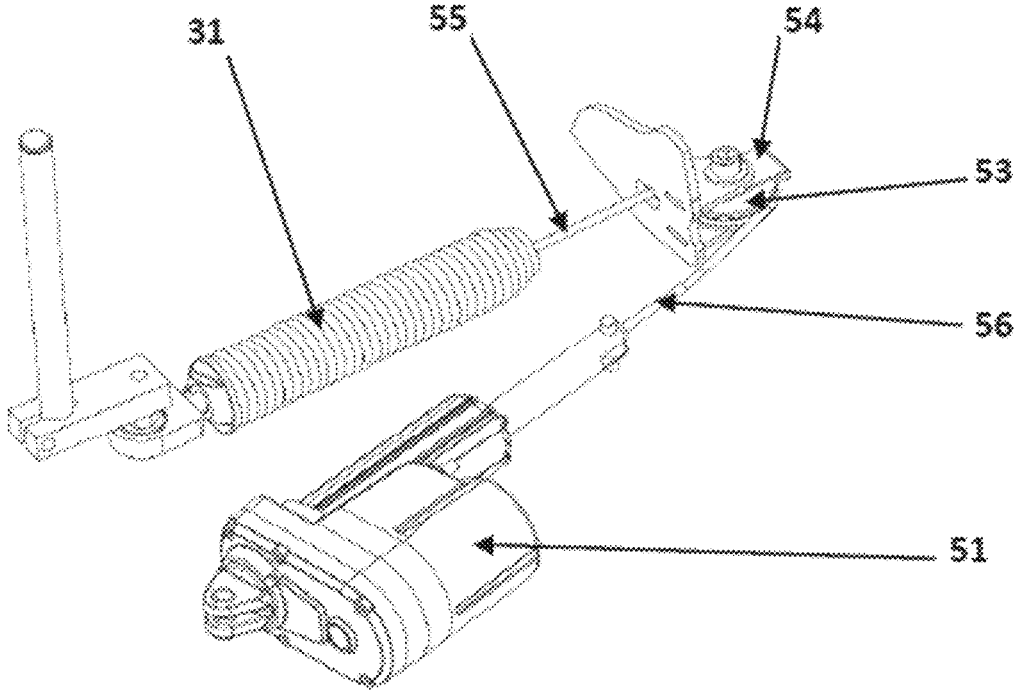
FIG. 4 shows the machine according to the invention with the actuator in the intermediate position for a zero preload.
Figure 5:
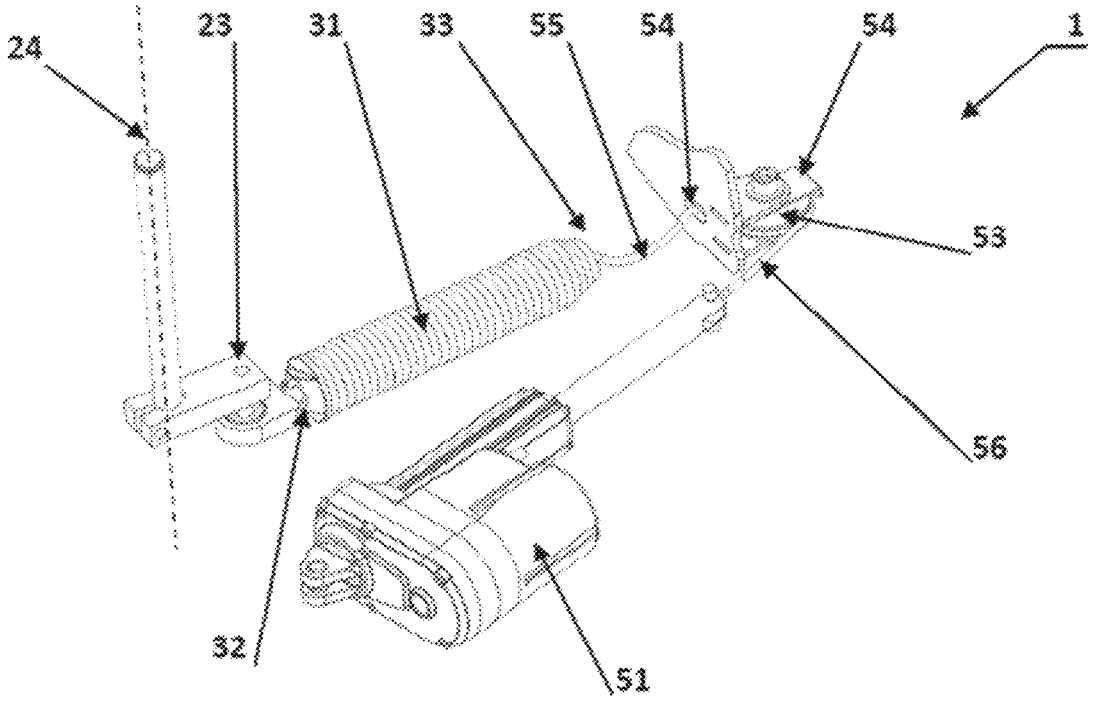
FIG. 5 shows the machine according to the invention with the actuator which is more extensive for a negative preload.

FIGS. 3 to 5 illustrate different prestressing position of the arming device, according to the position of the rod of the actuator 51, the arming device being moreover at rest, that is to say that the spring 31 has not yet been tensioned to accumulate target projection energy. This arming phase can take place, as described in the case of the prior art. FIGS. 3 to 5 therefore show preparation phases prior to arming and allowing adjusting the spring arming tension.

Thus FIG. 3 shows a linear actuator 51 substantially retracted to its shortest length, preloading the spring 31 to the maximum, for a maximum initial speed of the target. The member 52 is then in traction.

FIG. 4 shows the same linear actuator 51 in a configuration where its length is medium, for a lower initial speed of the target. Possibly, the spring is without prestress in this case, at rest. The traction on the member 52 is then minimal. This arrangement may correspond to what is conventionally obtained in a machine without adjustment capability.

FIG. 5 shows the same linear actuator 51 in a configuration where its length is further extended, substantially at the voltage limit of the flexible transmission means or member 52, for an even lower initial speed of the target. The member 52 is then deformed to create slack, by a bending or a curvature that it takes when the actuator 51 is deployed beyond the rest position of the spring 31. The flexible nature of the member in question means in particular the capacity of this member to deform without being broken or deteriorated, within reasonable operating limits. Thus, it can be folded or curved reversibly. In particular, it may be brought to be curved when these two ends are close together, unlike a rigid connection, such as a rod or a bar, which would have a deformation behaviour in tension/compression. It can for example be a cable, a rope or a belt. It can possibly also be a chain if it allows giving slack before loading the spring.

The use of a flexible transmission means or member 52 is advantageous in several respects. A first advantage is that the linear actuator 51 can expand beyond a rest position of the spring 31, leaving slack in the flexible transmission means 52. This advantageously allows configuring a negative preload for the spring 31. Thus, during the triggering, the start of the loading of the spring 31 is used to absorb said slack and does not immediately load the spring 31. Also during the triggering it is possible to have a load of the spring 31 much lower than for the prior art. Such a slack can thus lead to a force transmitted to the launching device 2 lower than the average force $k.L_0$, where k is the stiffness of the spring 31 and L0 is the triggering amplitude, but rather a force $k.(L_0-L_1)$, where $L_1$ is the slack length. This allows impelling a much lower initial speed to the target.

Such an expansion of the linear actuator 51, such that the flexible transmission means has slack, is more particularly illustrated in FIG. 5.

Figure 2:
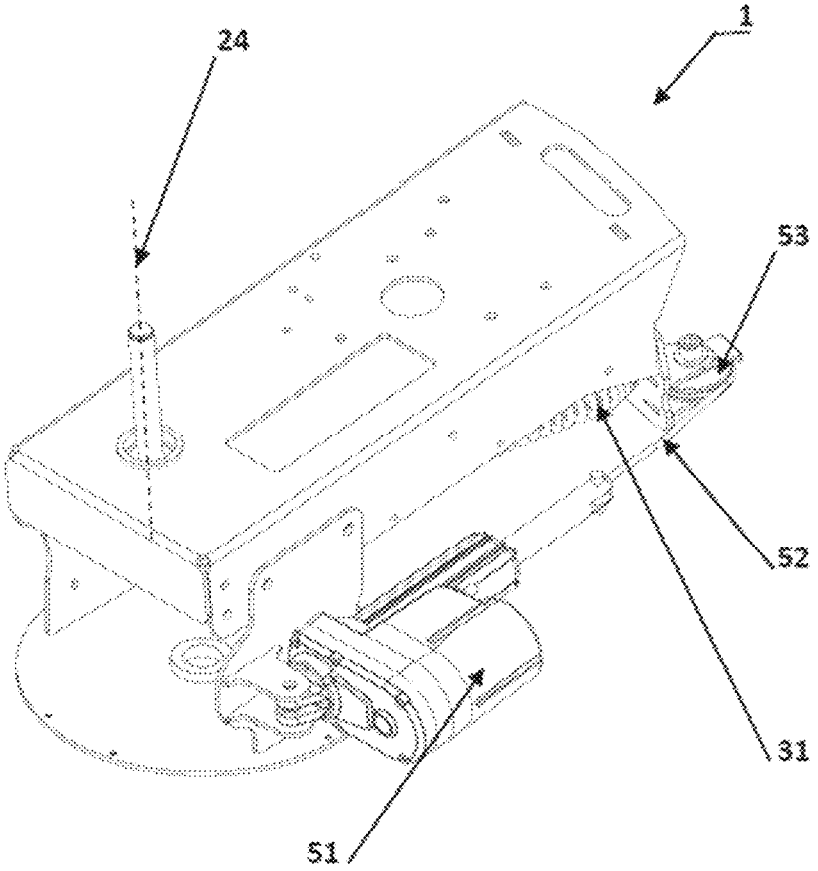
FIG. 2 shows an embodiment of a machine according to the invention.

Another advantage of the use of a flexible transmission means 52 is to allow the use of a deflection pulley 53, disposed on the flexible transmission means 52. This allows folding back the control line of the preload device in order, on the one hand, to better organise the implementation thereof in the machine 1 and on the other hand, to make said line more compact. Such a configuration is more particularly illustrated in FIG. 2.

In this figure, it should be noted that the pulley is mounted on the frame of the machine, and that two strands of the member 52 are organised on either side of this frame portion, advantageously symmetrically.

So that the deflection pulley 53 can cooperate effectively with the flexible transmission means 52, and in particular accept a possible slack of the latter, the deflection pulley 53 also advantageously comprises a guide 54 preventing the flexible transmission means 52 from leaving the deflection pulley 53. This guide 54 can take the form of a casing covering the groove of the deflection pulley 53, as illustrated in the Figure. It can also, alternatively or additionally, take the form of guide means 54, such as a hole in a shroud part of the machine 1 surrounding the flexible transmission means 52, as illustrated in FIG. 5. This hole can be provided for each strand of the member 52.

According to another feature, the linear actuator 51 and the deflection pulley 53 are secured to the machine 1 and disposed so that the deflection pulley 53 is substantially equidistant from the spring 31 and the linear actuator 51. Such a configuration advantageously allows, on the one hand, folding back the preload line, allowing substantially reducing the total space requirement of the machine 1 and also allows balancing the implemented forces by distributing them between the different portions of the frame of the machine 1. Such a configuration is more particularly illustrated in FIGS. 3 to 5.

According to another features, the flexible transmission means 52 comprises a cable, a rope or a belt. The term "cable" means any tether, preferably metallic and generally stranded. The term "rope" means any tether, preferably stranded and based on natural or artificial textile fibres (Nylon, Kevlar, etc.). The term "belt" mean any strand, advantageously reinforced with fibres, for example metal fibres, made of an elastomer matrix. Of course, the deflection pulley 53 has a profile and a material adapted to the flexible transmission means 52: grooved pulley, etc. The flexibility of the member 52 reflects its ability to be deformed other than in traction/compression, in at least one bending direction. This deformation being elastically reversible.

According to another feature, the linear actuator 51 comprises a cylinder which can be of any type: pneumatic, hydraulic. According to another feature, the cylinder is preferably electric.

Advantageously, the actuator 51 allows placing the device in any position between its states of deployment and maximum retraction, so that the adjustment is accurate.

After a target projection, the spring 31 is released which can generate vibrations, in particular at the second end 33 thereof. These vibrations could possibly disturb the operation of the invention, by inadvertent movements of the transmission member 52. In this case, the machine of the invention can be improved thanks to a system for guiding the spring 31, in its movements along its long dimension. Thus, when released, the second end 33 is held along the longitudinal axis of the spring and avoids the transverse movements of the member 52.

Figure 6:
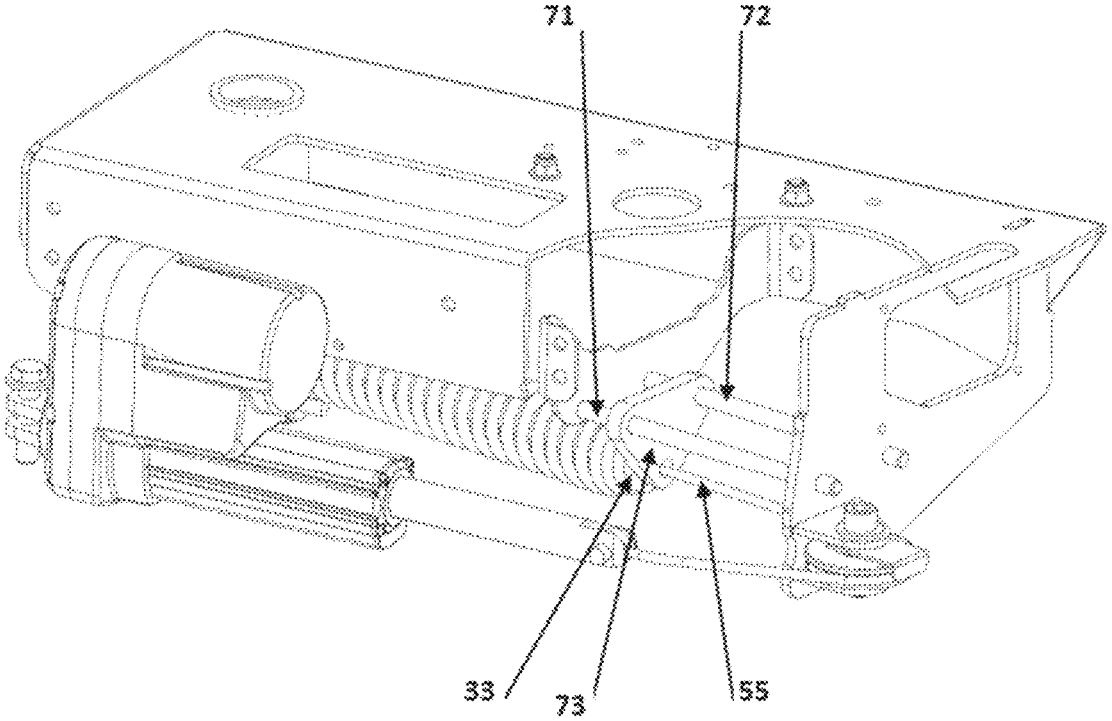
FIG. 6 shows a variant, with a guide of the spring.
Figure 7:
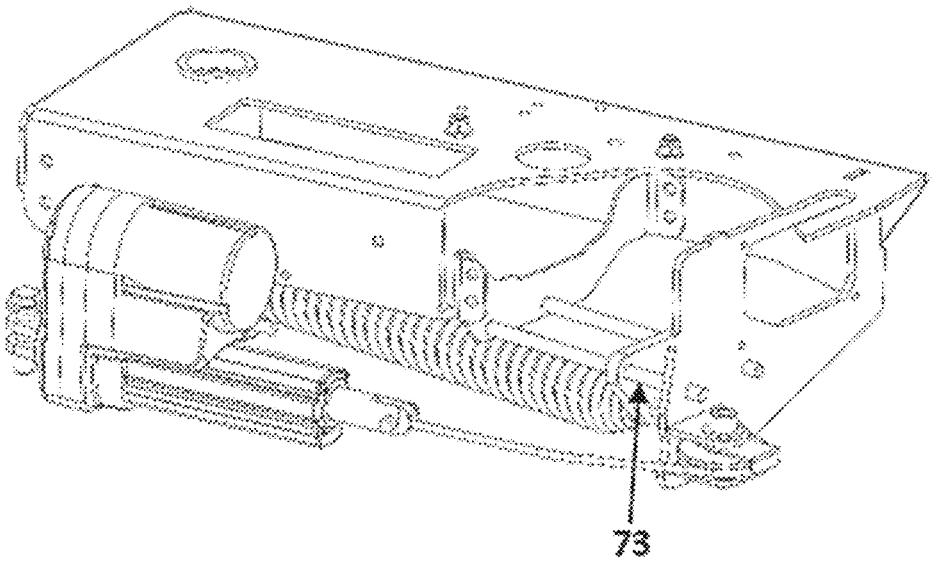
FIG. 7 represents another view of the variant of FIG. 6, with a different position of the second end of the spring.
Figure 8:
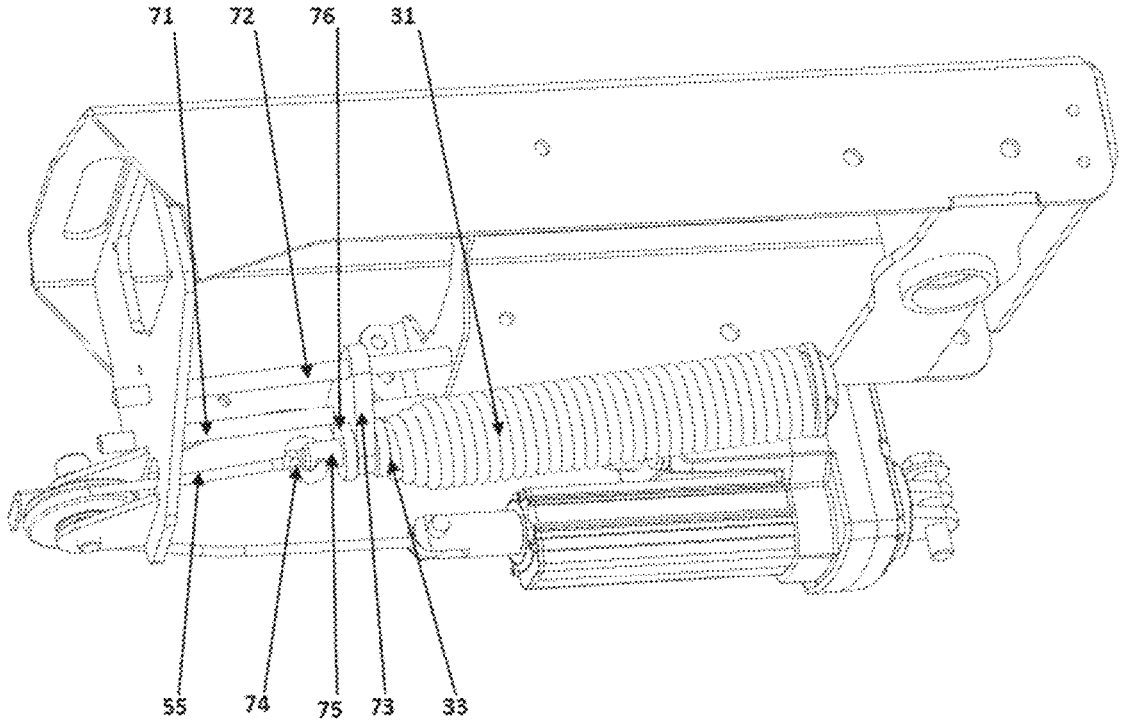
FIG. 8 shows in more detail a possibility of mounting the spring guide elements.

According to one possibility, as illustrated in FIGS. 6 to 8, the guide system comprises at least one rod 71, 72 mounted on the shroud of the machine, in particular at fastening areas. Preferably, at least two rods are used, so as to obtain the best possible guiding. Each rod extends in a direction parallel to the longitudinal dimension of the spring 31. On the other hand, the guide system includes, in this embodiment, a support 73 which is secured to the spring, at the second end 33 thereof. The support 73 comprises as many holes as necessary to cooperate with the rods 71, 72, such that the holes ensure the guiding of the rod 71, 72 corresponding thereto in the longitudinal direction.

Preferably, the support 73 further comprises a hole 74 for the passage of the member 52; possibly, the hole can be used as a first guide for the member 52 or participate in fastening the end thereof relative to the spring.

According to one possibility, a shouldered shaft 75 is inserted into the spring 31. The extension thereof allows the immobilisation of the support 73, for example via a blocking nut 76. It can further have, at the end thereof, a ring 74 ensuring the connection with the first strand 55. This configuration is represented in FIG. 8.

In the position of FIG. 6, the spring 31 is slightly tensioned and the support 73 is in a first relative position vis-a-vis the rods 71. In FIG. 7, the spring is more tensioned and the support 73 is located, in a more advanced manner, in the rods 71. For example, if the passage from the position of FIG. 6 to that of FIG. 7 occurs when the spring 31 is released, it is understood that the rods 71 avoid vibrations of the spring 31. After the release effect, the spring 31 will return to the rest position.

The invention has been illustrated and described in detail in the drawings and the preceding description. This must be considered as illustrative and given by way of example and not as limiting the invention to this single description.

LIST OF REFERENCES

1 machine
2 launching device
21 projection arms
22 distal end of 21
23 proximal end of 21
24 axis of rotation of 21
25 finger
3 accumulator device
31 spring
32 first end of 31
33 second end of 31
4 triggering device
41 finger
42 motor
43 axis
51 linear actuator
52 flexible transmission means or member
53 deflection pulley
54 guide
55 first strand
56 second strand
6 preloader device of the prior art
61 axis of rotation
62 rigid blade
63 eccentric
64 axis
71 rod
72 rod
73 support
74 ring
75 shaft
76 nut

The invention claimed is:

1. A machine for launching at least one target, comprising: a launching device comprising a rotary projection arm capable of projecting at least one target, an accumulator device comprising a spring including a first end being secured to a proximal end of the projection arm, a triggering device capable, in a first step, of displacing the proximal end of the projection arm and the first end of the spring by loading the spring so as to accumulate an elastic energy and, in a second step, of releasing the proximal end of the projection arm, which under an action of the spring releasing the previously accumulated elastic energy, is configured to project said at least one target, and a preloader device capable of adjusting a preload of the spring by displacing a second end of the spring, wherein the preloader device comprises a linear actuator and a flexible transmission member connecting the linear actuator to the second end of the spring.

2. The machine according to claim 1, wherein the preloader device is configured to leave slack in the flexible transmission member in order to create a delay in loading the spring.

3. The machine according to claim 1, wherein the preloader device comprises a deflection pulley on which the flexible transmission member is disposed.

4. The machine according to claim 3, wherein the deflection pulley comprises a guide preventing the flexible transmission member from leaving the deflection pulley.

5. The machine according to claim 4, wherein the guide comprises a casing surrounding a peripheral portion of the deflection pulley.

6. The machine according to claim 4, wherein the guide comprises at least one passage of a strand of the transmission member in a shroud of the machine.

7. The machine according to claim 3, wherein the linear actuator and the deflection pulley are secured to the machine.

8. The machine according to claim 1, wherein the flexible transmission member is selected from a cable, a rope or a belt.

9. The machine according to claim 1, further comprising a guide system configured to guide the spring along the longitudinal dimension thereof.

10. The machine according to claim 9, wherein the guide system comprises at least one rod oriented parallel to the longitudinal dimension and mounted on a shroud of the machine, and a support part secured to the second end of the spring and defining, for each rod, a hole for guiding said rod.

11. The machine according to claim 1, wherein the linear actuator comprises a cylinder.

12. The machine according to claim 1, further comprising a guide system connected with the machine.

* * * * *